US009691306B2

(12) United States Patent
Lee et al.

(10) Patent No.: US 9,691,306 B2
(45) Date of Patent: Jun. 27, 2017

(54) TRANSPARENT DISPLAY BOARD WITH STRUCTURE OF DOUBLE LAYER TYPE AND MANUFACTURING METHOD THEREOF

(71) Applicant: G-SMATT CO., LTD., Gyeonggi-do (KR)

(72) Inventors: Ho Joon Lee, Seoul (KR); Hak Ryul Shin, Busan (KR)

(73) Assignee: G-SMATT CO., LTD., Gyeonggi-Do (KR)

( * ) Notice: Subject to any disclaimer, the term of this patent is extended or adjusted under 35 U.S.C. 154(b) by 0 days.

(21) Appl. No.: 14/652,776

(22) PCT Filed: Dec. 8, 2014

(86) PCT No.: PCT/KR2014/011986

§ 371 (c)(1),
(2) Date: Jun. 16, 2015

(87) PCT Pub. No.: WO2015/088206

PCT Pub. Date: Jun. 18, 2015

(65) Prior Publication Data

US 2016/0275831 A1 Sep. 22, 2016

(30) Foreign Application Priority Data

Dec. 10, 2013 (KR) ..... 10-2013-0152768

(51) Int. Cl.

| | |
|---|---|
| ***G09F 9/33*** | (2006.01) |
| ***G09F 19/22*** | (2006.01) |
| ***H05B 33/04*** | (2006.01) |
| ***H05B 33/10*** | (2006.01) |
| ***H05B 33/28*** | (2006.01) |

(52) U.S. Cl.

CPC ..... *G09F 9/33* (2013.01); *G09F 19/226* (2013.01); *H05B 33/04* (2013.01); *H05B 33/10* (2013.01); *H05B 33/28* (2013.01)

(58) Field of Classification Search

CPC ..... G09F 9/33; G09F 19/226; H05B 33/28; H05B 33/04; H05B 33/10

See application file for complete search history.

(56) References Cited

U.S. PATENT DOCUMENTS

2012/0267614 A1* 10/2012 Tajima ..... H01L 51/0096 257/40
2015/0001516 A1* 1/2015 Yoshida ..... H01L 51/0021 257/40

* cited by examiner

*Primary Examiner* — Donald Raleigh
*Assistant Examiner* — Kevin Quarterman
(74) *Attorney, Agent, or Firm* — The PL Law Group, PLLC

(57) ABSTRACT

The present invention relates to a transparent electric billboard having a multilayer structure and a manufacturing method thereof, and more particularly, to a transparent electric billboard having a multilayer structure that have high insulation and soundproof effect by having a multilayer structure with spaces therein, and a method of manufacturing the transparent electric billboard.

8 Claims, 4 Drawing Sheets

TRANSPARENT DISPLAY BOARD WITH STRUCTURE OF DOUBLE LAYER TYPE AND MANUFACTURING METHOD THEREOF

CROSS REFERENCE TO RELATED APPLICATIONS AND CLAIM OF PRIORITY

This patent application claims benefit under 35 U.S.C. 119(e), 120, 121, or 365(c), and is a National Stage entry from International Application No. PCT/KR2014/011986, filed Dec. 8, 2014, which claims priority to Korean Patent Application No. 10-2013-0152768, filed Dec. 10, 2013, entire contents of which are incorporated herein by reference.

TECHNICAL FIELD

The present invention relates to a transparent electric billboard having a multilayer structure and a manufacturing method thereof, and more particularly, to a transparent electric billboard having a multilayer structure that has high insulation and soundproof effect by having a multilayer structure with spaces therein, and a method of manufacturing the transparent electric billboard.

BACKGROUND ART

In general, as outdoor light emitting devices, electric billboards using a neon lamp, a CCL (Cold Cathode Lamp), and LEDs (Light Emitting Diode) are widely used. As indoor light emitting devices, an EEFL (External Electrode Fluorescent Lamp), a CCFL (Cold Cathode Fluorescent Lamp), and light emitting diode electric billboard are used.

The neon lamp or the CCL consumes a large amount power because it uses high-voltage power, so a danger of an electric shock or a fire is high and the lifespan is short. Further, the EEFL or the CCFL is difficult to use outdoor because it uses a high frequency, the intensity of illumination is low and the lifespan is short.

Further, in an electric billboard using LEDs, the rear side of a light emitting side is blocked by a cover because the wires on the rear side are finished with a black sheathing, so light is emitted only in one direction.

Recently, light emitting devices are used not only for lighting, but for advertising, so they are manufactured in various aesthetic deigns and used for interior decoration.

However, there is a limit in esthetic designs of the light emitting devices due to the limit in the size of lamps and the size of stands supporting the light emitting device.

Accordingly, a plurality of light emitting elements is attached to a transparent electrode to an aesthetic design and they are controlled to show characters or symbols through the transparent electrode. Further, there are even transparent electric billboards that can show moving images. Those transparent electric billboards are mounted with a plurality of light emitting elements having two electrodes, three electrodes, or four electrodes on a transparent electrode. A transparent electric billboard has been disclosed in Korean Patent No. 79950 (Nov. 21, 2007).

However, the transparent electric bulletin board as manufactured for aesthetic interior decoration or advertisement does not have an insulating function that can maintain the interior temperature of a building. Accordingly, when it is installed around windows of a house or an office building, it is expensive to heat and cool the building.

DISCLOSURE

Technical Problem

Accordingly, the present invention has been made keeping in mind the above problems occurring in the related art, and the present invention is intended to propose a transparent electric billboard having a multilayer structure that is made of a transparent material for insulating and soundproofing, and a method of manufacturing the transparent electric billboard.

Technical Solution

According to another aspect of the present invention, there is provided a transparent electric billboard having a multilayer structure that includes: a first transparent plate having a transparent electrode and transparent patterns on a side so that power can be supplied to a plurality of light emitting element; a second transparent plate bonded to the side of the first transparent plate on which the light emitting elements are mounted; a protective layer formed by injecting and hardening resin between the first transparent plate and the second transparent plate and protecting the light emitting elements and the transparent patterns; one or more space bars longitudinally formed and disposed at edges of the second transparent plate; and a third transparent plate bonded to the tops of the space bars and defining a space with the second transparent plate.

Advantageous Effects

According to the present invention, since a transparent electric billboard is formed in a multilayer structure, it can be installed not only for advertisement and interior decoration, but around windows of houses and office buildings. Therefore, it can be used in various ways and reduces the cost for cooling and heating houses or office buildings.

BEST MODE

Figure 1:
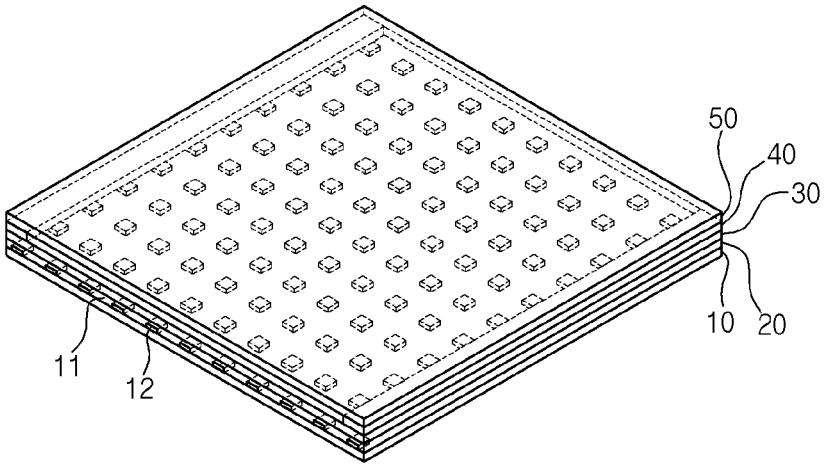
FIG. 1 is a perspective view showing a transparent electric billboard having a multilayer structure according to the present invention.

The space between the second transparent plate and the third transparent plate in the embodiment described above in Technical Solution is under a vacuum state.

In another embodiment of the present invention, the space between the second transparent plate and the third transparent plate is filled with an argon gas.

In another embodiment of the present invention, the space bars are temporarily bonded to the second transparent plate and the third transparent plate by an adhesive material and the adhesive material is a double-sided tape or epoxy.

In another embodiment of the present invention, the transparent electric billboard having a multilayer structure is bonded and fixed by a finishing material applied to cross-sections and edges of the first transparent plate to the third transparent plate, and the space between the second transparent plate and the third transparent plate is completely sealed.

According to another aspect of the present invention, there is provided a method of manufacturing a transparent electric billboard having a multilayer structure. The method includes: an electrode forming step that forms a transparent electrode and one or more transparent patterns spaced from each other to be insulated on the transparent electrode, on a side of a first transparent plate, and mounts light emitting elements on the transparent patterns; a second transparent plate bonding step that bonds a second transparent plate to a side of the first transparent plate after the electrode forming step; a resin injecting step that forms a protective layer by injecting resin between the first transparent plate and the second transparent plate, using free fall from above, and then hardening the resin, after the second transparent plate bonding step; a space bar bonding step that bonds space bars longitudinally extending, to edges of the second transparent plate, after the resin injecting step; and a third transparent plate bonding step that places a third transparent plate onto the space bars and then bonds the third transparent plate such that a space is defined between the second transparent plate and the third transparent plate, after the space bar bonding step.

In another embodiment of the present invention, the method further includes an epoxy finishing step that seals and bonds the space between the second transparent plate and the third transparent plate by applying liquid-state epoxy to cross-sections and edges of the first transparent plate and the third transparent plate, after the third transparent plate bonding step.

In another embodiment of the present invention, the space bar bonding step temporarily bonds the space bars to edges of the second transparent plate, using a double-sided tape or epoxy, and the third transparent plate bonding step temporarily bonds the third transparent plate to the space bars, using a double-sided tape or epoxy.

MODE FOR INVENTION

Hereinafter, embodiments of a transparent electric billboard having a multilayer structure according to the present invention and a method of manufacturing the transparent electric billboard will be described with reference to the accompanying drawings.

FIG. 1 is a perspective view showing a transparent electric billboard having a multilayer structure according to the present invention.

Referring to FIG. 1, a transparent electric billboard having a multilayer structure according to the present invention includes: a first transparent plate 10 on which one or more light emitting elements 12, 12', 12", 12''' are mounted; a second transparent plate 20 bonded to the first transparent plate 10; a protective layer 30 made of resin injected in between the first transparent plate 10 and the second transparent plate 30; one or more space bars 40 attached to the edges of a side of the second transparent plate 30; and a third transparent plate 50 supported by the space bars 40 at a predetermined distance from the second transparent plate 30.

Figure 2:
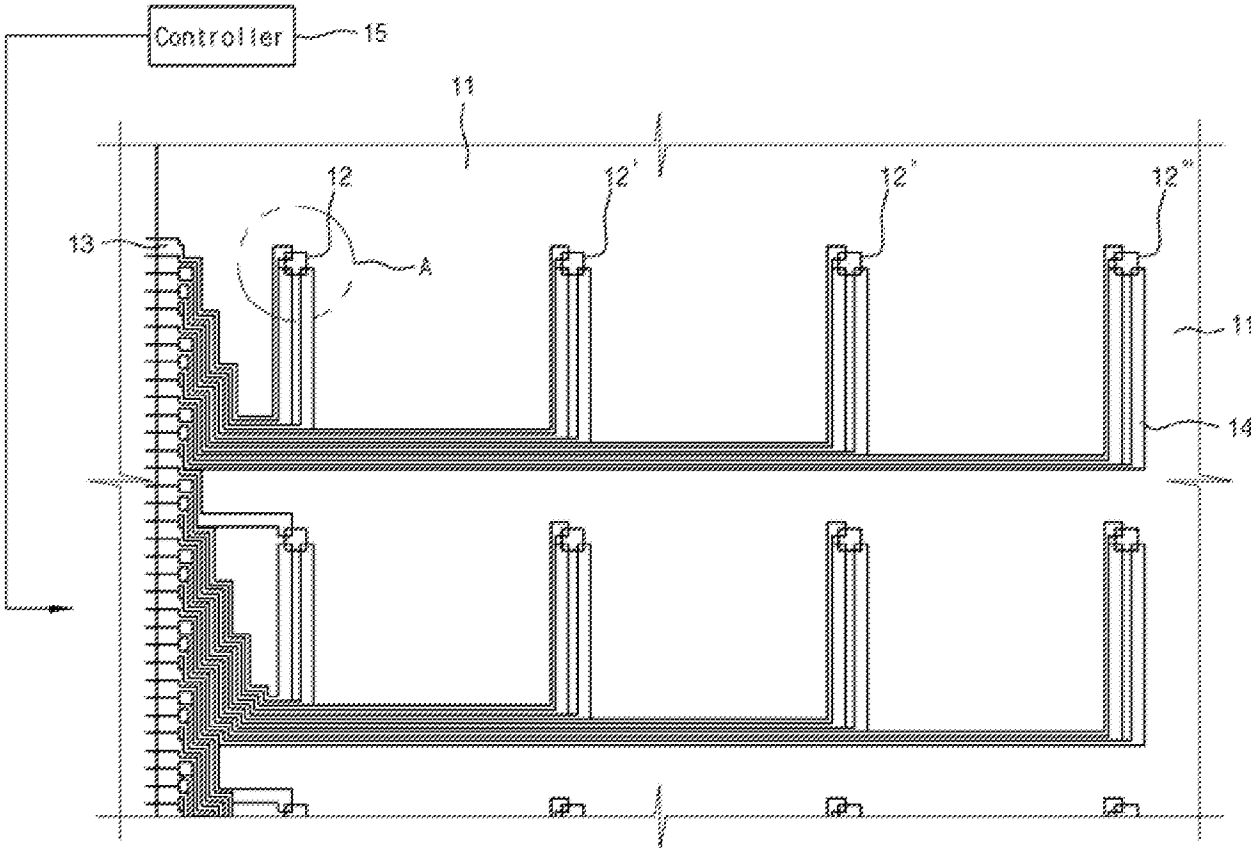
FIG. 2 is a plan view showing a first transparent plate in the transparent electric billboard having a multilayer structure.

The first transparent 10 is described with reference to FIGS. 2 and 3. FIG. 2 is a plan view showing the first transparent plate 10 of the transparent electric billboard having a multilayer structure according to the present invention and FIG. 3 is an enlarged view showing the portion 'A' in FIG. 2.

Figure 3:
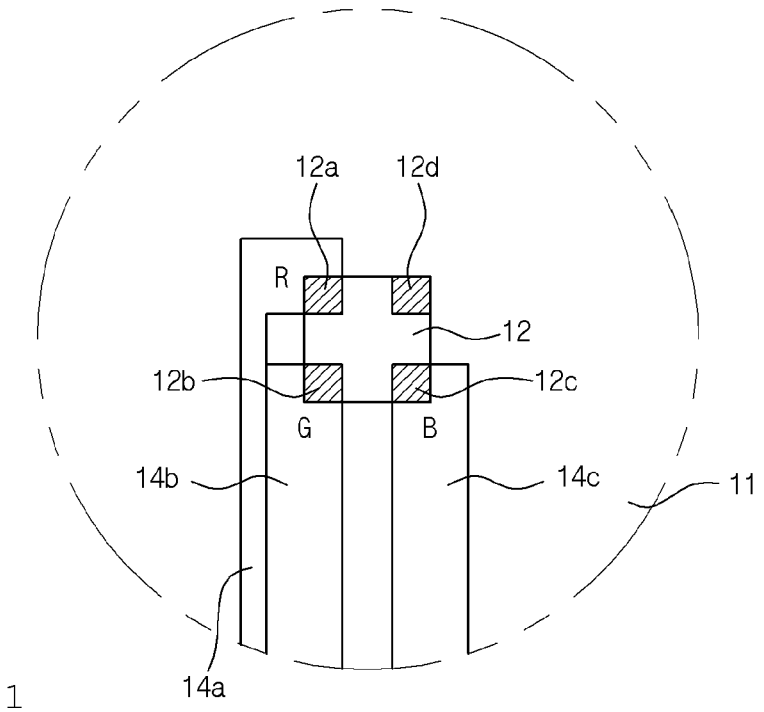
FIG. 3 is an enlarge view of the portion 'A' in FIG. 2.

Referring to FIGS. 2 and 3, the first transparent 10 includes a transparent electrode 11 made of a conductive ink on a side of the first transparent 10, one or more transparent patterns 14 formed on the transparent pattern 11 by etching to be insulated from a transparent electrode or anther pattern, one or more light emitting elements 12, 12', 12", and 12''', a controller 15 outputting a control signal for controlling the light emitting elements 12, 12', 12", and 12''', and control terminals 13 connected with the controller 15.

The transparent electrode 11 is formed by applying a conductive ink or a conductive material including ITO (Indium Tin Oxide) or CNT (Carbon Nano Tube) glass throughout a side of the first transparent plate 10.

The control terminals 13 are patterned from the transparent electrode 11, on one or more edges of the first transparent plate 10 and the controller 15 is connected to the control terminals 13. The control terminals 13 are connected to transparent patterns 14 extending from the light emitting elements 12, 12', 12", and 12''', so control signals from the controller 15 are outputted.

The transparent patterns 14 extend from the control terminals 13 and the number of the transparent patterns 14 is the same as that of anodes of the light emitting elements 12, 12', 12", and 12'''. For example, when the light emitting elements 12, 12', 12", and 12''' are four-electrode light emitting elements 12, 12', 12", and 12''' in which first to third electrodes 12*a* to 12*c* are anodes and a fourth electrode 12*d* is a cathode, the transparent patterns 14 are composed of first to third transparent patterns 14*a* to 14*c* to which the first to third electrodes 12*a* to 12*c* are bonded. The fourth electrode 12*d* of the light emitting elements 12, 12', 12", and 12''' is bonded to the transparent electrode 11, so there is no specific connection pattern.

That is, the transparent patterns 14 are composed of the first transparent pattern 14*a* to which the first electrode 12*a* of the four-electrode light emitting elements 12, 12', 12", and 12''' is attached, the second transparent pattern 14*b* to which the second electrode 12*b* is bonded, and the third transparent pattern 14*c* to which the third electrode 12*c* is bonded.

The light emitting elements 12, 12', 12", and 12''' are bonded at ends of the transparent patterns 14 by a conductive adhesive. As described above, the light emitting elements 12, 12', 12", and 12''' have one or more anodes 12*a* to 12*c* and the anodes 12*a* to 12*c* are bonded to the ends of the transparent patterns 14*a* to 14*b*, respectively, by a conductive adhesive.

Accordingly, on the first transparent plate 10, the transparent patterns 14 are formed and the light emitting elements 12, 12', 12", and 12''' are mounted, and the second transparent plate 30 is bonded to a side facing the side of the first transparent plate 10 where the light emitting elements 12, 12', 12", and 12''' are mounted.

The protective layer 20 is made of resin, which is injected in between the first transparent plate 10 and the second transparent plate 30 and bonds the first transparent plate 10 and the second transparent plate 30, and protects the transparent patterns and the light emitting elements 12, 12', 12", and 12'" on the first transparent plate 10 from humidity or outside contamination.

The space bars 40 are attached longitudinally to both sides of the side, which is opposite to the side facing the first transparent plate 10, on the second transparent plate 30. The space bars 40 are described with reference to FIGS. 4 and 5.

Figure 4:
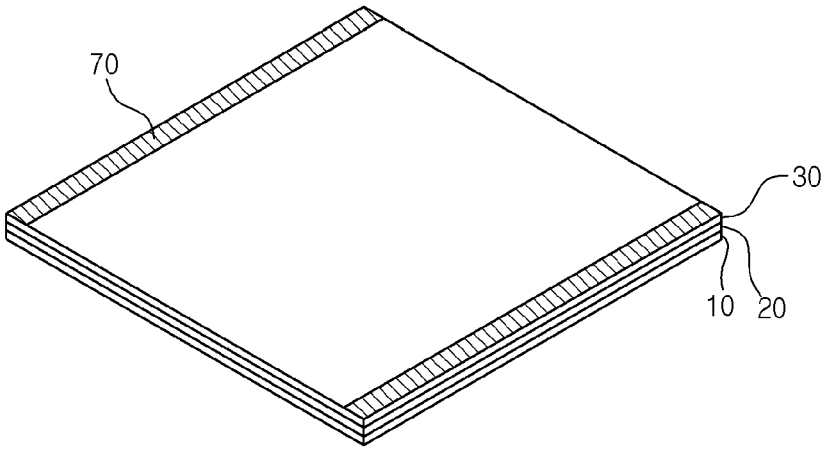
FIG. 4 is a perspective view showing the transparent electric billboard having a multilayer structure according to the present invention.
Figure 5:
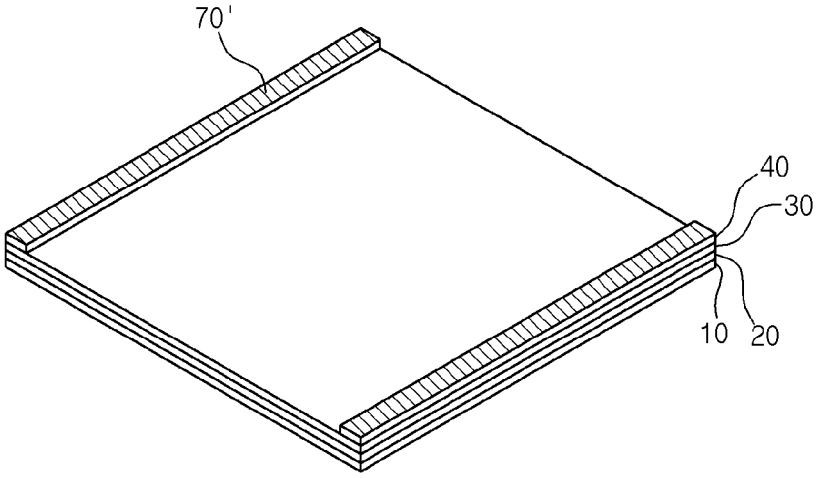
FIG. 5 is a perspective view showing space bars of the transparent electric billboard having a multilayer structure according to the present invention.

FIG. 4 is a perspective view showing the transparent electric billboard having a multilayer structure according to the present invention, and FIG. 5 is a perspective view showing the space bars of the transparent electric billboard having a multilayer structure according to the present invention.

Referring to FIGS. 4 and 5, the space bars 40, which are longitudinally extending bars, have a predetermined thickness and are bonded to the edges of the second transparent plate 30. The space bars 40 are made of glass or metal and may not be made of a transparent material if they can be covered by a frame (not shown) supporting a transparent electric billboard.

The space bars 40 are temporarily bonded to both edges of the second transparent plate 30 by a double-sided tape or epoxy. The double-sided tape or the epoxy is provided to temporarily bond the space bars 40 and any other materials can be used as long as they can bond the space bars 40 to the second transparent plate 30. In the following description, the materials that can temporarily bond the space bars such as the double-sided tape or the epoxy are generally referred as an adhesive material 70 and 70'.

The adhesive materials 70 and 70' are provided at both or more edges of the second transparent plate 30 and on the space bars 40, so they temporarily bonds the space bars 40 to the third transparent plate 50.

The third transparent plate 50 is seated on the space bars 40 temporarily bonded to the second transparent plate 30 and spaced from the second transparent plate 30. The third transparent plate 50 is temporarily bonded to the space bars 40 by the adhesive material 70'. The third transparent plate 50 is made of a light transmissive material to transmit light from the light emitting elements on the first transparent plate 10, in which Low-E glass having an insulation function or other common transparent glass may be used. Since the third transparent plate 50 is spaced from the second transparent plate 20, it can improve the insulating and soundproofing function of the transparent electric billboard.

The present invention can be modified in various ways in accordance with intentions of businesspersons or designers, so the third transparent plate 50 made of a transparent material is not necessarily used in manufacturing a transparent electric billboard in a multilayer structure. That is, the third transparent plate 50 may be replaced with a resin plate made of color glass or light transmission materials that can transmit light from light emitting element in accordance with intentions of businesspersons or designers and this case is included in various modifications within the scope of the present invention.

As described above, the third transparent plate 50 and the space bars 40 are temporarily bonded by the adhesive materials 70 and 70' and the completely bonded by a finishing material. The finishing material, which is liquid-state epoxy, seals the space between the second transparent plate and the third transparent plate and completely bonds the second transparent plate 20 with the space bars 40 and the space bars 40 with the third transparent plate 50.

According to the present invention, it is preferable to make the space between the second transparent plate 30 and the third transparent plate 50 a vacuum by discharging air therein for insulating and soundproofing or to inject a gas (for example, Ar) under a vacuum state, before finishing with the epoxy.

The present invention includes the configuration described above and a method of manufacturing a transparent electric billboard having a multilayer structure including the configuration is described hereafter with reference to a flowchart in the accompanying drawings.

Figure 6:
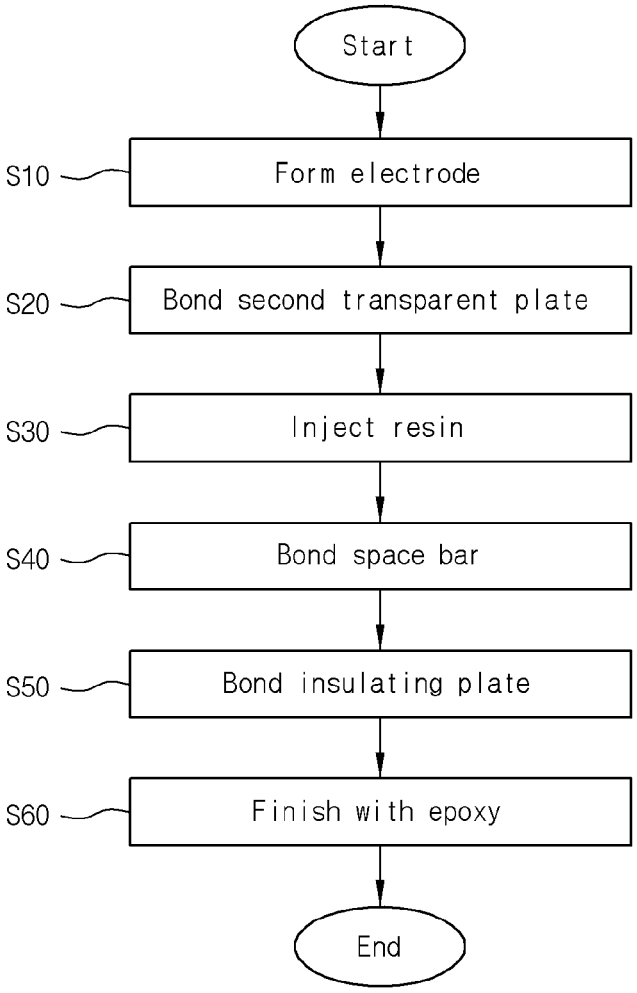
FIG. 6 is a flowchart illustrating a method of manufacturing a transparent electric billboard having a multilayer structure according to the present invention.

FIG. 6 is a flowchart illustrating a method of manufacturing a transparent electric billboard having a multilayer structure according to the present invention.

Referring to FIG. 6, a method of manufacturing a transparent electric billboard having a multilayer structure according to the present invention includes: an electrode forming step (S10) that forms a transparent electrode 11 on a first transparent plate 10 and mounts light emitting elements 12, 12', 12", and 12'"; a second transparent bonding step (S20) that temporarily bonds a second transparent plate 30 to the first transparent plate 10; a resin injecting step (S30) that injects and hardens resin between the first transparent plate 10 and the second transparent plate 30 to bond the first transparent plate 10 and the second transparent plate 30; a space baring bonding step (S40) that temporarily bonds space bars 40 by applying adhesive materials 70 and 70' to the second transparent plate 30; a third transparent plate bonding step (S50) that bonds a third transparent plate 50 after the space bar bonding step (S40); and epoxy finishing step (S60) that finishes and fixes the first to third transparent plates 10 to 50 with epoxy.

The electrode forming step (S10) is a step of forming the conductive transparent electrode 11 by applying a conductive ink or a conductive material to a side of the first transparent plate 10, forming insulating control terminals 13 and transparent patterns 14 at a predetermined distance from the transparent electrode 11, and then mounting the light emitting elements 12, 12', 12", and 12'". The transparent electrode 11 is conductive because a light transmissive conductive adhesive or a light transmissive conductive material is applied throughout a side of the first transparent plate 10.

The control terminals 13 are patterned at one or more edges of the first transparent plate 10, at a predetermined distance from the transparent electrode 11. The controller 15 is a flexible circuit board (not shown) and connected to the control terminals 13. The flexible circuit board (not shown) is bonded to the control terminals 13 by a conductive adhesive.

The transparent patterns 14 extend from the control terminals 13 and are spaced to be insulated from another electrode. Further, the number of the transparent patterns 14 is the same as the number of the light emitting elements 12, 12', 12", and 12'".

The light emitting elements 12, 12', 12", and 12'" are bonded by the conductive adhesive such that anodes 12*a* to 12*c* are positioned at the ends of the transparent patterns 14 and a cathode 12*d* is positioned at the transparent electrode 11.

The second transparent plate bonding step (S20) is a step of bonding a double-sided tape (not shown) to one or more sides of the first transparent plate 10, placing the second transparent plate 30 on the opposite side to the double-sided tape, and then bonding the first transparent plate 10 and the second transparent plate 30. The second transparent plate 30 is mounted on a side of the first transparent plate 10 on which the transparent patterns 14 and the light emitting elements 12, 12', 12", and 12'" are mounted.

The resin injecting step (S30) is a step of forming a protective layer 20 between the first transparent plate 10 and the second transparent plate 30 by injecting and hardening resin in between the first transparent plate 10 and the second transparent plate 30. The protective layer 20 is formed by injecting resin between the first transparent plate 10 and the second transparent plate 30, which are temporarily bonded by the double-sided tapes, and then hardening the resin with a UV hardening device (not shown). Accordingly, the first transparent plate 10 and the second transparent 30 are fixed by the protected layer 20 formed by injecting and hardening resin. Further, the resin is transparent resin.

The space bar bonding step (S40) is a step of placing an adhesive material 70 selected from a double-sided tape or epoxy at both edges or one or more edges of the opposite side of the second transparent plate 30 and then temporarily bonding the space bars 40 to the edges of the second transparent plate 03. The space bars 40 longitudinally extend from a side opposite to the side of the second transparent plate 30 which is bonded to the first transparent plate 10, and are bonded by the adhesive material 70. The space bars 40 have a predetermined thickness and are spaced from each other on the second transparent plate 30.

The third transparent plate bonding step (S50) is a step of bonding the third transparent plate 50 to the space bars 40 after applying an adhesive material 70' to the tops of the space bars 40. The space bars 40 are bonded to the third transparent plate 50 by the adhesive material 70' applied thereon, which is one of a double-sided tape and epoxy. The third transparent plate 50 is supported by the space bars 40 at both sides, so a space is formed between the third transparent plate 50 and the second transparent plate 30.

The epoxy finishing step (S60) is a step of finishing the transparent electric billboard by applying liquid-state epoxy to the edges of the first transparent plate 10 to the third transparent plate 50. The third transparent plate 50 and the space bars 40 are temporarily bonded by the adhesive materials 70 and 70' and completely bonded and finished by the epoxy. The epoxy is applied to some of the edges and cross-sections of the first transparent plate 10 to the third transparent plate 10 and prevents water, air, or other dirt from flowing into the first transparent plate 10 to the third transparent plate 50. It is preferable that the finishing with epoxy is applied only to areas where the transparent electric billboard is covered by a window frame or a frame that can function as a window frame.

Further, it is preferred to make a multilayer for improving insulating and soundproofing between the second transparent plate 20 and the third transparent plate 50 by discharging the air in the space between the second transparent plate 20 and the third transparent plate 50 into a vacuum state, or injecting an argon gas after making a vacuum state. The finishing with epoxy may be performed after or before the vacuum state is made and/or the gas is injected. The process described above is one of various embodiments, and the process order may be modified in various ways by businesspersons or designers.

Therefore, according to the present invention, the third transparent plate 50 is disposed in a transparent electric billboard in a multilayer structure, so insulating and soundproofing are achieved. Accordingly, it can replace windows of houses and office buildings and reduce the cost for cooling and heating, so it can be used in various fields.

INDUSTRIAL APPLICABILITY

The present invention relates to a transparent electric billboard and can be used in various ways such as a window frame of a building due to a multilayer structure providing a cooling/heating effect, in addition to decorating the interior and outputting information inside and outside of buildings.

The invention claimed is:

1. A transparent electric billboard having a multilayer structure, comprising:

a first transparent plate having a transparent electrode and transparent patterns on a side so that power can be supplied to a plurality of light emitting element;

a second transparent plate bonded to the side of the first transparent plate on which the light emitting elements are mounted;

a protective layer formed by injecting and hardening resin between the first transparent plate and the second transparent plate and protecting the light emitting elements and the transparent patterns;

a third transparent plate laminated on the upper surface of the second transparent plate; and one or more space bars formed on the upper surface of the second transparent plate and supporting the third transparent plate so that the second transparent plate and third transparent plate are spaced from each other.

2. The transparent electric billboard of claim 1, wherein the space between the second transparent plate and the third transparent plate is under a vacuum state.

3. The transparent electric billboard of claim 1, wherein the space between the second transparent plate and the third transparent plate is filled with an argon gas.

4. The transparent electric billboard of claim 1, wherein the space bars are temporarily bonded to the second transparent plate and the third transparent plate by an adhesive material and the adhesive material is a double-sided tape or epoxy.

5. The transparent electric billboard of claim 1, wherein the transparent electric billboard having a multilayer structure is fixed by a finishing material applied to cross-sections and edges of the first transparent plate to the third transparent plate, and the space between the second transparent plate and the third transparent plate is completely sealed.

6. A method of manufacturing a transparent electric billboard having a multilayer structure, the method comprising:

an electrode forming step that forms a transparent electrode and one or more transparent patterns spaced from each other to be insulated on the transparent electrode, on a side of a first transparent plate, and mounts light emitting elements on the transparent patterns;

a second transparent plate bonding step that bonds a second transparent plate to a side of the first transparent plate after the electrode forming step;

a resin injecting step that forms a protective layer by injecting resin between the first transparent plate and the second transparent plate, using free fall from above, and then hardening the resin, after the second transparent plate bonding step;

a space bar bonding step that bonds space bars longitudinally extending, to edges of the second transparent plate, after the resin injecting step; and a third transparent plate bonding step that places a third transparent plate onto the space bars and then bonds the third transparent plate such that a space is defined between the second transparent plate and the third transparent plate, after the space bar bonding step.

7. The method of claim 6, further comprising an epoxy finishing step that seals and bonds the space between the second transparent plate and the third transparent plate by applying liquid-state epoxy to cross-sections and edges of the first transparent plate and the third transparent plate, after the third transparent plate bonding step.

8. The method of claim 6, wherein the space bar bonding step temporarily bonds the space bars to edges of the second transparent plate, using a double-sided tape or epoxy, and the third transparent plate bonding step temporarily bonds the third transparent plate to the space bars, using a double-sided tape or epoxy.

* * * * *